US006652071B2

(12) United States Patent
Silverbrook

(10) Patent No.: US 6,652,071 B2
(45) Date of Patent: Nov. 25, 2003

(54) THERMAL EXPANSION COMPENSATION FOR MODULAR PRINTHEAD ASSEMBLY

(75) Inventor: Kia Silverbrook, Balmain (AU)

(73) Assignee: Silverbrook Research Pty Ltd, Balmain (AU)

( * ) Notice: Subject to any disclaimer, the term of this patent is extended or adjusted under 35 U.S.C. 154(b) by 0 days.

(21) Appl. No.: 10/129,438

(22) PCT Filed: Mar. 9, 2001

(86) PCT No.: PCT/AU01/00259

§ 371 (c)(1),
(2), (4) Date: May 6, 2002

(87) PCT Pub. No.: WO01/66356

PCT Pub. Date: Sep. 13, 2001

(65) Prior Publication Data

US 2003/0038859 A1 Feb. 27, 2003

(30) Foreign Application Priority Data

Mar. 10, 2000 (AU) ..... PQ 6158

(51) Int. Cl.[7] ..... B41J 2/155
(52) U.S. Cl. ..... 347/49
(58) Field of Search ..... 347/12, 13, 17, 347/20, 40, 42, 49

(56) References Cited

U.S. PATENT DOCUMENTS 5,160,945 A * 11/1992 Drake ..... 347/42
5,734,394 A * 3/1998 Hackleman ..... 347/42
6,325,488 B1 * 12/2001 Beerling et al. ..... 347/42
6,460,966 B1 * 10/2002 Hellekson et al. ..... 347/20

FOREIGN PATENT DOCUMENTS

| | | |
|---|---|---|
| EP | 1 043 158 A2 | 10/2000 |
| JP | 10157108 A | 6/1998 |
| JP | 10181015 A | 7/1998 |
| JP | 11010861 A | 1/1999 |
| JP | 2000263768 A | 9/2000 |
| WO | WO 99/65690 | 12/1999 |

* cited by examiner

*Primary Examiner*—Stephen D. Meier
*Assistant Examiner*—Julian D. Huffman

(57) ABSTRACT

A printhead assembly (1) for an inkjet printer, the printhead assembly (1) including:

a composite support member (3) for attachment to the printer, the composite support member (3) being formed of at least two materials (5, 6, 7) and having a unitary mounting element (5);

a printhead (2) adapted for mounting to the mounting element (5); wherein, the materials (5, 6, 7) of the support member (3) are selected and structurally combined such that the coefficient of thermal expansion of the support member (3) is substantially equal to the coefficient of thermal expansion of the printhead (2).

In the context of the present invention, "the coefficient of thermal expansion of the support member" is a reference to the effective coefficient of thermal expansion of the mounting element taking into account any external influences from the rest of the support.

11 Claims, 1 Drawing Sheet

THERMAL EXPANSION COMPENSATION FOR MODULAR PRINTHEAD ASSEMBLY

FIELD OF THE INVENTION

The present invention relates to printers and in particular to digital inkjet printers.

CO-PENDING APPLICATIONS

Various methods, systems and apparatus relating to the present invention are disclosed in the following co-pending applications filed by the applicant or assignee of the present invention on May 24, 2000:

| | | | |
|---|---|---|---|
| PCT/AU00/00578 | PCT/AU00/00579 | PCT/AU00/00581 | PCT/AU00/00580 |
| PCT/AU00/00582 | PCT/AU00/00587 | PCT/AU00/00588 | PCT/AU00/00589 |
| PCT/AU00/00583 | PCT/AU00/00593 | PCT/AU00/00590 | PCT/AU00/00591 |
| PCT/AU00/00592 | PCT/AU00/00584 | PCT/AU00/00585 | PCT/AU00/00586 |
| PCT/AU00/00594 | PCT/AU00/00595 | PCT/AU00/00596 | PCT/AU00/00597 |
| PCT/AU00/00598 | PCT/AU00/00516 | PCT/AU00/00517 | PCT/AU00/00511 |

Various methods, systems and apparatus relating to the present invention are disclosed in the following co-pending application, PCT/AU00/01445, filed by the applicant or assignee of the present invention on Nov. 27, 2000. The disclosures of these co-pending applications are incorporated herein by cross-reference. Also incorporated by cross-reference, are the disclosures of two co-filed PCT applications, PCT/AU01/00261 and PCT/AU01/00260 (deriving priority from Australian Provisional Patent Application Nos. PQ6110 and PQ6111). Further incorporated is the disclosure of two co-pending PCT applications filed Mar. 6, 2001, application numbers PCT/AU01/00238 and PCT/AU01/00239, which derive their priority from Australian Provisional Patent Application nos. PQ6059 and PQ6058.

BACKGROUND OF THE INVENTION

Recently, inkjet printers have been developed which use printheads manufactured by micro-electro mechanical systems (MEMS) techniques. Such printheads have arrays of microscopic ink ejector nozzles formed in a silicon chip using MEMS manufacturing techniques. The invention will be described with particular reference to silicon printhead chips for digital inkjet printers wherein the nozzles, chambers and actuators of the chip are formed using MEMS techniques. However, it will be appreciated that this is in no way restrictive and the invention may also be used in many other applications.

Silicon printhead chips are well suited for use in page-width printers having stationary printheads. These printhead chips extend the width of a page instead of traversing back and forth across the page, thereby increasing printing speeds. The probability of a production defect in an eight inch long chip is much higher than a one inch chip. The high defect rate translates into relatively high production and operating costs.

To reduce the production and operating costs of page-width printers, the printhead may be made up of a series of separate printhead modules mounted adjacent one another, each module having its own printhead chip. To ensure that there are no gaps or overlaps in the printing produced by adjacent printhead modules it is necessary to accurately align the modules after they have been mounted to a support beam. Once aligned, the printing from each module precisely abuts the printing from adjacent modules.

Unfortunately, the alignment of the printhead modules at ambient temperature will change when the support beam expands as it heats up to the operating temperature of the printer.

SUMMARY OF THE INVENTION

According to a first aspect, the present invention provides a printhead assembly for an inkjet printer, the printhead assembly including:

- a composite support member and a printhead;
- said composite support member having a unitary mounting element and an outer shell;
- said mounting element and outer shell formed from different materials;
- said printhead adapted for mounting to the mounting element and said outer shell adapted for attachment to a printer;
- the materials of the support member are selected and structurally combined such that the coefficient of thermal expansion of the support member is substantially equal to the coefficient of thermal expansion of the printhead;
- wherein the support member allows limited relative movement between the mounting element and the outer shell.

For the purposes of this specification, "the coefficient of thermal expansion of the support member" is the effective coefficient of thermal expansion of the mounting element taking into account any external influences from the rest of the support.

Preferably, the printhead is two or more printhead modules that separately mount to the mounting element, each of the modules having a silicon MEMS chip, wherein the mounting element is also formed from silicon.

In a particularly preferred form, the support member further includes a metal portion adapted for attachment to the printer.

Preferably the mounting element is supported by, and adjustably positionable within, the metal portion.

In some embodiments, the printer is a pagewidth printer and the support member is a beam with an elongate metal shell enclosing a central core formed from silicon. Conveniently, the beam is adapted to allow limited relative movement between the silicon core and the metal shell. To achieve this the beam may include an elastomeric layer interposed between the silicon core and the metal shell. Furthermore, the outer shell may be formed from laminated layers of at least two different metals.

It will be appreciated that through careful design and material selection, the coefficient of thermal expansion of the mounting section of the support member can be made to substantially match the coefficient of thermal expansion of the printhead chips. Without any significant differences between the thermal expansion of the printhead and the mounting section of the support member, the problems of printhead module misalignment are avoided. By designing the support member to accommodate some relative movement between the outer shell and mounting section, the problems of bowing are also avoided.

BRIEF DESCRIPTION OF THE DRAWING

A preferred embodiment of the present invention will now be described by way of example only, with reference to the accompanying drawing, in which.

DETAILED DESCRIPTION OF THE PREFERRED EMBODIMENTS

Figure 1:
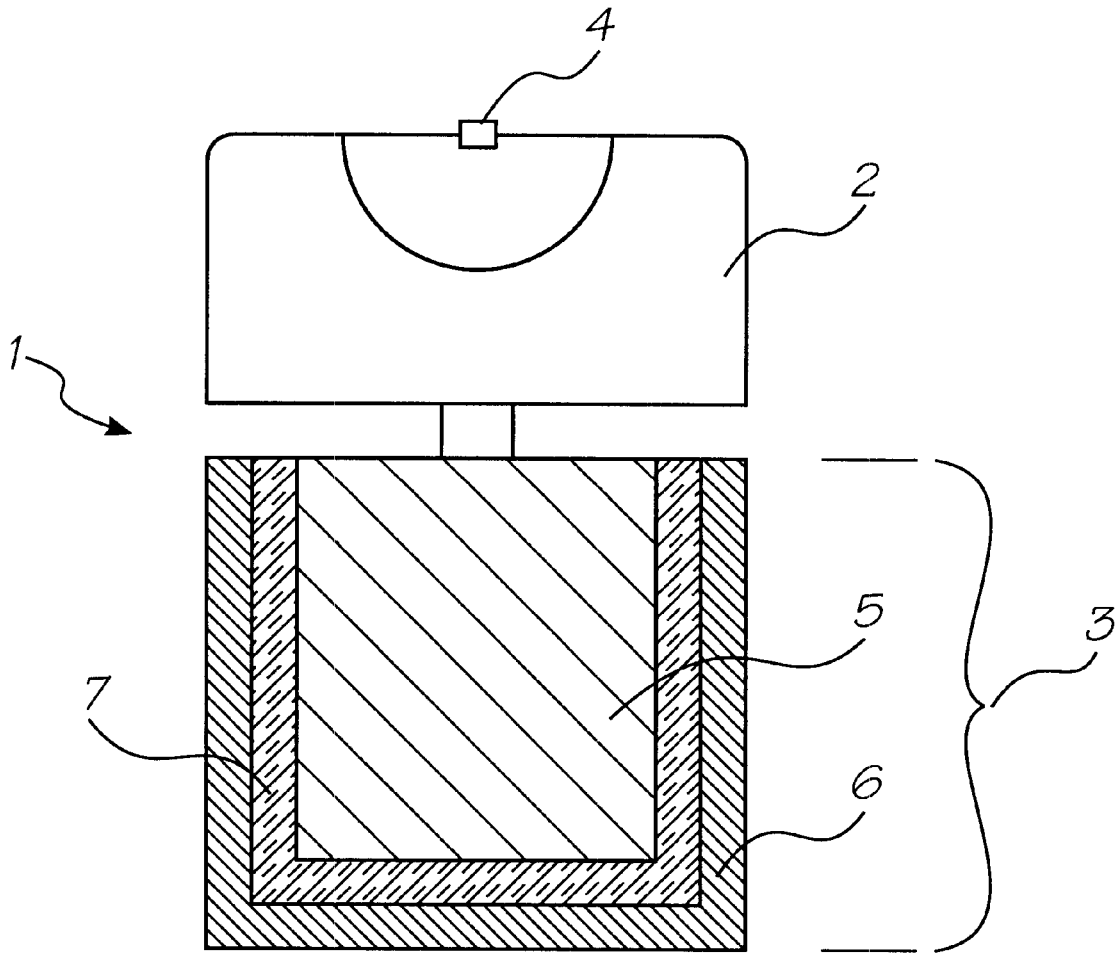
FIG. 1 is a schematic cross section of a printhead assembly according to the present invention.

Referring to the FIGURE, the printhead assembly 1 has a printhead module 2, is fixed to a support beam 3 adapted for mounting in a digital printer (not shown). The printhead module 2 has a silicon printhead chip 4. The chip has an array of ink nozzles, chambers and actuators formed using MEMS techniques.

To ensure that any misalignment of the printing produced by adjacent printhead modules 2 does not exceed a predetermined maximum, the coefficient of thermal expansion of the support beam 3 should closely match the coefficient of thermal expansion of silicon. The maximum and minimum allowable coefficients of thermal expansion for the support beam 3 can be calculated using:

the maximum permissible misalignment between adjacent printheads; and, the difference between ambient temperature (or more particularly the temperature at which the modules 2 are mounted and aligned on the support beam 3) and the equilibrium operating temperature and the length of the printhead chips using the following formula:

$$|M_{CTE} - P_{CTE}| \leq \frac{\Delta X_{\max}}{\Delta TL}$$

where:

$\Delta X_{max}$ is the maximum acceptable misalignment between printhead modules;

$\Delta T$ is the difference between the temperature when the modules were mounted and aligned on the support beam and the equilibrium operating temperature of the printer;

L is the length of the printhead chip.

$M_{CTE}$ is the coefficient of thermal expansion of the support beam; and $P_{CTE}$ is the coefficient of thermal expansion of the printhead chip.

It will be appreciated that for:

$$\Delta X_{max}=1\times10^{-6}\ m$$

$$\Delta T=40^\circ\ \text{C.}$$

$$L=20\ \text{mm}$$

then:

$$|M_{CTE} - P_{CTE}| \leqq 1.25\times10^{-6}\ m/^0\ C$$

and if a silicon printhead is used $$P_{CTE}=2.6\times10^{-6}\ m/^0C$$

then the maximum and minimum values for the coefficient of thermal expansion of the support beam are:

$$M_{CTE}=2.6\pm1.25\times10^{-6}\ m/^0C.$$

This provides a parameter that can be used to select appropriate materials and structural configurations for the support beam 3. In one preferred form, the beam 3 includes a silicon core element 5 bonded to a metallic outer shell 6 by an intermediate layer 7. The modules 2 mount to the core element 5 which helps to reduce the effective coefficient of thermal expansion of the support beam 3 such that it falls within the acceptable range.

An elastomeric layer 7 may be interposed between the outer shell 6 and the core element 5 such that the influence of the outer shell on the coefficient of thermal expansion of the silicon core element is reduced.

Alternatively, the silicon core element 5 may be mounted for limited sliding within the outer shell 6 in order to negate or reduce any influence from the generally high coefficients of thermal expansion of metals.

The present invention has been described herein with reference to specific examples. Skilled workers in this field would readily recognise that the invention may be embodied in many other forms.

What is claimed is:

1. A printhead assembly for an inkjet printer, the printhead assembly including:

a composite support member and a printhead;

said composite support member having a unitary mounting element and an outer shell placed around at least part of the mounting element;

said mounting element and outer shell formed from different materials;

said printhead adapted for mounting to the mounting element and said outer shell adapted for attachment to a printer;

the materials of the support member are selected and structurally combined such that the coefficient of thermal expansion of the support member is substantially equal to the coefficient of thermal expansion of the printhead;

wherein the support member allows limited relative movement between the mounting element and the outer shell.

2. The printhead assembly of claim 1 wherein an elastomeric layer is interposed between the mounting element and the outer shell.

3. The printhead assembly of claim 1 wherein the mounting element is supported by and adjustably postitionable within the outer shell.

4. The printhead assembly of claim 1 wherein the printhead is formed from two or more printhead modules that separately mount to the mounting clement.

5. The printhead assembly of claim 4 wherein each module is made from the same material as the mounting element.

6. The printhead assembly of claim 4 wherein each of the modules has a silicon MEMS chip.

7. The printhead assembly of claim 1 wherein the support member is a beam that is formed by an outer shell that encloses the mounting element.

8. The printhead assembly of claim 1 wherein the outer shell is formed from metal.

9. The printhead assembly of claim 8 wherein the outer shell is formed from laminated layers of at least two different metals.

10. The printhead assembly of claim 1 wherein the mounting member is formed from silicon.

11. The printhead assembly of claim 1 wherein the printer is a pagewidth printer.

* * * * *